US008172557B2

(12) United States Patent
Hilger et al.

(10) Patent No.: US 8,172,557 B2
(45) Date of Patent: May 8, 2012

(54) HIGH-PRESSURE GAS COMPRESSOR AND METHOD OF OPERATING A HIGH-PRESSURE GAS COMPRESSOR

(75) Inventors: Ulrich Hilger, Ratingen (DE); Bernd Bartunek, Monheim (DE); Martin Blank, Hamm (DE)

(73) Assignee: Westport Power Inc., Vancouver, BC (CA)

( * ) Notice: Subject to any disclaimer, the term of this patent is extended or adjusted under 35 U.S.C. 154(b) by 444 days.

(21) Appl. No.: 12/024,965

(22) Filed: Feb. 1, 2008

(65) Prior Publication Data

US 2008/0213115 A1 Sep. 4, 2008

Related U.S. Application Data

(63) Continuation of application No. PCT/CA2006/001276, filed on Aug. 3, 2006.

(30) Foreign Application Priority Data

Aug. 4, 2005 (CA) ..... 2511254

(51) Int. Cl.
*F04B 39/10* (2006.01)
*F04B 53/10* (2006.01)

(52) U.S. Cl. ..... 417/569

(58) Field of Classification Search ..... 417/53, 417/214, 470, 471, 569, 374, 392; 73/78; 92/178, 134; 91/321, 417 R
See application file for complete search history.

(56) References Cited

U.S. PATENT DOCUMENTS 3,029,324 A * 4/1962 Couffer, Jr. et al. ..... 200/83 Q
3,199,929 A * 8/1965 McLean et al. ..... 384/29
3,300,997 A * 1/1967 Kocher ..... 62/117
3,370,545 A * 2/1968 Waibel ..... 417/571
3,961,868 A * 6/1976 Droege, Sr. et al. ..... 417/550
4,032,263 A 6/1977 Pareja
4,099,597 A * 7/1978 Powell et al. ..... 184/27.3
4,242,063 A * 12/1980 Pareja ..... 417/571
4,251,081 A * 2/1981 Skoog ..... 277/512
4,515,530 A * 5/1985 Christoleit ..... 417/214
4,873,951 A * 10/1989 Garthwaite ..... 123/196 W
5,078,580 A 1/1992 Miller et al.
5,374,168 A * 12/1994 Kozawa et al. ..... 417/471
(Continued)

FOREIGN PATENT DOCUMENTS

EP 1498600 1/2005

*Primary Examiner* — Devon C Kramer
*Assistant Examiner* — Amene Bayou
(74) *Attorney, Agent, or Firm* — McAndrews, Held & Malloy, Ltd.

(57) ABSTRACT

A high-pressure gas compressor comprises a single-acting cam driven piston with a pressure compensation chamber disposed between the piston and the cam. A roller tappet assembly transmits reciprocating motion from the cam to the piston. A pressurized gas directed to the pressure compensation chamber offsets forces acting on the piston from the compression chamber gas pressure, thereby reducing Hertzian pressure between the tappet roller and the cam. Overall efficiency and durability can be improved by reducing friction between compressor components, for example by employing thin film coatings to reduce friction, pressurized oil lubrication systems and higher cylinder bore diameter to piston stroke ratios. The service life of gas seals and compression efficiency can be improved by thermal management strategies, including liquid-cooled compressor cylinder liners and intercoolers between compression stages. Employing a poppet-style intake valve and reducing parasitic volume in the compression chamber can improve compressor volumetric efficiency.

34 Claims, 5 Drawing Sheets

U.S. PATENT DOCUMENTS 5,400,751 A 3/1995 Grimmer et al.
5,606,938 A * 3/1997 Rowe ..... 123/54.3
5,632,605 A * 5/1997 Bez ..... 417/266
5,832,906 A 11/1998 Douville et al.
6,217,299 B1 4/2001 Jay
6,991,438 B2 * 1/2006 Blessing et al. ..... 417/273
2002/0022129 A1 * 2/2002 Moronuki ..... 428/408

* cited by examiner

HIGH-PRESSURE GAS COMPRESSOR AND METHOD OF OPERATING A HIGH-PRESSURE GAS COMPRESSOR

CROSS-REFERENCE TO RELATED APPLICATION(S)

This application is a continuation of International Application No. PCT/CA2006/001276, having an international filing date of Aug. 3, 2006, entitled "High-Pressure Gas Compressor and Method of Operating a High-Pressure Gas Compressor". International Application No. PCT/CA2006/001276 claimed priority benefits, in turn, from Canadian Patent Application No. 2,511,254 filed Aug. 4, 2005. International Application No. PCT/CA2006/001276 is hereby incorporated by reference herein in its entirety.

FIELD OF THE INVENTION

The present invention relates to a high-pressure gas compressor and a method of operating the compressor. In a particularly suitable embodiment, the disclosed apparatus relates to a gas compressor with a reciprocating single-acting piston with a drive mechanism that comprises a cam and roller tappet assembly and means for reducing the Hertzian pressure between the roller and cam.

BACKGROUND OF THE INVENTION

Engine-driven reciprocating piston compressors have been known since the industrial revolution. Compressor designs have improved over time to improve volumetric and overall energy efficiency, to improve performance for higher compression ratios and higher discharge gas pressures, to increase durability, and to reduce manufacturing costs. Improvements are still being made today.

For a compressor with a cam and roller tappet assembly, with higher compression ratios, and higher discharge pressures come the potential for higher Hertzian pressures between the tappet roller and cam. Hertzian pressure can be reduced by increasing the size of the roller to increase the contact surface area between the roller and cam. However, there are practical limits to the size of the roller because increasing the roller size also adds to the weight and overall size of the compressor. For a compactly designed high-pressure compressor, it is usually impractical to maintain Hertzian pressure below desired limits by increasing roller size alone. Higher Hertzian pressures beyond material limitations will increase wear and can result in mechanical failure and consequently reduce the service life of the rollers and/or cams if measures are not taken to reduce Hertzian pressure and/or increase the durability of the tappet roller and cam.

The goal of increasing volumetric efficiency has led to the design of compressors with low cylinder bore diameter to piston stroke ratios. Volumetric efficiency is inversely proportional to the parasitic volume, which is a physical characteristic associated with each compressor design. The parasitic volume is the gas-filled volume remaining in the compression chamber at the end of a compression stroke, when the piston is fully extended (when the piston is at top dead center). Some clearance is required between the fully extended piston and the cylinder head to avoid damage that might be caused by the piston contacting the cylinder head or contact with valve components that might be extendable into the compression chamber. The gap between the piston and the cylinder bore that is between the piston head and the first piston ring seal also contributes to the parasitic volume. There may also be respective passages between inlet and outlet valve seats and the compression chamber that also contribute to the parasitic volume. The compressor does work to compress the gas in the parasitic volume to a high pressure, but at the end of the compression stroke, the piston can not move beyond its fully extended position to discharge the compressed gas from the parasitic volume of the compression chamber. Furthermore, when the compressor piston retracts during the subsequent intake stroke to draw more gas into the compression chamber for the next compression stroke, new gas can not be drawn into the cylinder until after the compressed gas that was in the parasitic volume has expanded to the point where its pressure is less than the supply pressure of the gas that is to be drawn in through the inlet valve. Therefore, a larger parasitic volume reduces the amount of new gas that can be drawn into the compression chamber on each subsequent intake stroke and this results in lower volumetric efficiency.

For known high-pressure gas compressors it is considered necessary to reduce the cylinder bore diameter to piston stroke ratio, to reduce the parasitic volume and improve volumetric efficiency to desirable levels. That is, since there is a limit to how much one can reduce the spacing between the piston and the cylinder head at the end of the compression stroke, in modern compressors, for a given displacement, parasitic volume is reduced by reducing the size of the bore and increasing the stroke length. For example, with known high-speed piston compressors for compressing natural gas to 250 bar, bore to piston stroke ratios of the high pressure stage are normally less than 0.5 and typically as low as 0.3, which corresponds to a stroke length that is up to 3.4 times larger than the cylinder bore diameter. For low and medium compression stages, the respective bore to stroke ratios can be as high as 2 and as low as 0.5.

Mechanically driven piston compressors can use a crankshaft connected to the piston by piston rods, like the arrangement used for internal combustion engines. The compressor can even be incorporated into the engine block, using the same crankshaft that is driven by the engine pistons, with some of the pistons being used by the engine to generate power and other pistons used for gas compression, such as is disclosed in U.S. Pat. No. 5,400,751, entitled "Monoblock Internal Combustion Engine With Air Compressor Components". However, such arrangements can be more complicated and less efficient than an arrangement that employs a piston driven by a cam and roller tappet assembly, such as that disclosed by Miller et al. U.S. Pat. No. 5,078,580. In addition, a compressor with a piston driven by a cam and roller tappet assembly can be more compact so that the size of the compressor can be reduced, compared to the size of a compressor driven by a crankshaft and a piston rod. Miller discloses a piston assembly wherein the compressor piston comprises a stem that is screwed into a crosshead. The piston assembly further comprises a roller mounted in the crosshead by a pin. A spring causes the piston to retract downwards to follow the cam surface. However, a problem with this arrangement is that the piston, crosshead, and roller are fixedly attached to each other and each of these components must be aligned with another component: the piston with the cylinder, the crosshead with a guide, and the roller with the cam. With compressors in general, and especially for compressors designed for high gas pressures, it is desirable to reduce the clearance between the piston and the cylinder. Consequently, the assembly taught by Miller would be expensive to manufacture because of the small manufacturing tolerances needed to for alignment of the piston in the cylinder, the crosshead in the guide, and the roller on the cam. Miller also does not disclose an arrangement that would be suitable for operating with longer intervals between servicing and high durability. For example, Miller does not disclose a means for lubricating the tappet roller assembly. Furthermore, another important drawback of the compressor disclosed by Miller is that it does not provide a means for reducing the force acting on the piston resulting from the gas pressure in the compression chamber and consequently the Hertzian pressure between the roller and cam can be too high. A problem specific to cam and roller tappet assemblies is wear of the cam and rollers, which is a problem that can be amplified in a compressor that is designed for handling high-pressure gases. The Hertzian pressure is the contact pressure between the cam and roller, and damage or accelerated wear can result if the Hertzian pressure is too high. Another disadvantage of excessively high forces resulting from high gas pressures in the compression chamber is that it can result in higher friction in the drive train and consequently, lower overall efficiency. For compressors with variable intake gas pressure, such as compressors that are employed to pressurize gas supplied from a storage vessel, it can be difficult to guard against excessive Hertzian pressure because gas pressure in the compression chamber is variable, depending upon gas pressure in the storage vessel.

Douville et al. U.S. Pat. No. 5,832,906 discloses an intensifier apparatus. An intensifier apparatus is a type of compressor that can be employed to increase the pressure of a gas supplied from a variable pressure source to a higher pressure. Douville discloses a two stage compressor with piping that connects the supply pipe to the back side of the first-stage piston through a back pressure port, permitting the intensifier to run in an idle operating mode with the load on the first and second stage pistons balanced while no compression takes place. Douville discloses a scotch yoke arrangement for using a rotating cam to drive the compressor pistons. Such an arrangement is useful for a two-piston, two-stage compressor but is not suitable for other arrangements, such as a single-stage, single-piston compressor, or a three-stage, three-piston compressor. Douville does not disclose a means for reducing Hertzian pressure that can be applied to each cylinder of both single and multi-piston compressors.

SUMMARY OF THE INVENTION

A gas compressor is provided that comprises:

(a) a compressor body that comprises a cam case and at least one cylinder block;

(b) a cylinder bore formed within the cylinder block and open onto the cam case and externally onto an outer surface of the cylinder block;

(c) a cylinder head covering the outer surface of the cylinder block and comprising an inlet passage through which an intake gas stream is introducible into the cylinder bore and a discharge passage through which a discharge gas stream is dischargeable from the cylinder bore;

(d) an inlet valve disposed in the inlet passage of the cylinder head;

(e) an outlet valve disposed in the discharge passage of the cylinder head;

(f) a camshaft rotatably mounted in the cam case with a cam associated with the camshaft that is aligned with a centerline axis of the cylinder bore;

(g) a single-acting piston reciprocable within the cylinder bore;

(h) a roller tappet assembly interposed between the piston and the cam for transmission of reciprocating motion from the cam to the piston, the roller tappet assembly comprising:

a tappet body contactable with the piston:

a roller with a rolling surface in contact with the perimeter surface of the cam; and a pin extending through the roller defining an axis of rotation, wherein the pin is supported by mounting points provided by the tappet body;

(i) a pressure compensation passage within the compressor body through which a pressurized gas is introducible to a pressure compensation chamber interposed between the piston and the cam case, wherein the pressure compensation chamber is bounded in part by a surface of the piston that is opposite to a piston surface that faces the cylinder head.

The gas compressor preferably comprises a free-floating piston. An advantage of the free-floating piston design is that it reduces the number of components that require precise alignment. That is, the piston, which is reciprocable within the cylinder bore, does not have to be precisely aligned with the roller tappet assembly that is reciprocable within a bearing sleeve. The feature has additional importance with the presently disclosed compressor because there is an additional seal for the pressure compensation chamber to prevent pressurized gas from leaking from the pressure compensation chamber to the cam case. The free-floating piston arrangement avoids the requirement of aligning the piston, stem and roller tappet assembly with each other, simplifying the manufacturing process and improving the operability and durability.

For multi-stage compressors, another advantage of the presently disclosed compressor with its free-floating pistons is that it can be less expensive to manufacture because the tappets for each of the stages can all be the same, with only the separately manufactured pistons having different diameters. This can also reduce the cost of spare parts and the number of spare parts kept in inventory.

A method of compressing a gas using the disclosed compressor is provided. The method comprises introducing pressurized gas into a compression chamber during an intake stroke, and offsetting a portion of the forces acting on the piston from gas pressure within the compression chamber by introducing a pressurized gas into a pressure compensation chamber between the piston and the camshaft, wherein the pressure compensation chamber is bounded in part by a surface of the piston that is opposite to a surface that faces the compression chamber. The intake gas stream can come from a storage vessel or a pipeline. If the pressurized intake gas stream comes from a storage vessel, intake gas pressure varies depending upon how much gas is in the storage vessel. If the pressurized intake gas stream comes from a pipeline, the pressure depends upon the pressure that is maintained in the pipeline. For example, in some distribution pipelines, this pressure can be between 10 and 16 bar. Because the intake gas stream is pressurized, it can apply a force on the compressor piston to maintain contact between the piston and the roller tappet assembly.

The method can comprise directing pressurized gas from the intake gas stream to the pressure compensation chamber, or directing pressurized gas from another source, such as the discharge line from the compressor, and controlling gas pressure that is directed to the pressure compensation chamber to control the Hertzian pressure between the roller of the roller tappet assembly and the cam. In the preferred method this Hertzian pressure is maintained below 1400 N per square millimeter, and more preferably below 1200 N per square millimeter.

The method can further comprise coating metal surfaces that interface with gas seals that comprise polytetrafluoroethylene. The coating is a thin film coating that increases surface hardness and reduces the coefficient of friction to lower than that of steel, providing a desirably smooth surface that helps to provide a good seal, and reduce the heat generated by friction between the seal and moving components such as the cylinder bore and the piston stem. In preferred embodiments, the coating is a diamond-like carbon thin film.

The disclosed compressor design is particularly advantageous for vehicular applications where it is important to provide a compressor with a compact and light weight design, that can be mechanically driven by the vehicle engine with high compressor speed, that takes advantage of the engine's water-cooled cooling system for compressor temperature management, and that has low parasitic volume to achieve a high volumetric efficiency.

BRIEF DESCRIPTION OF THE DRAWING(S)

DETAILED DESCRIPTION OF PREFERRED EMBODIMENT(S)

Figure 1:
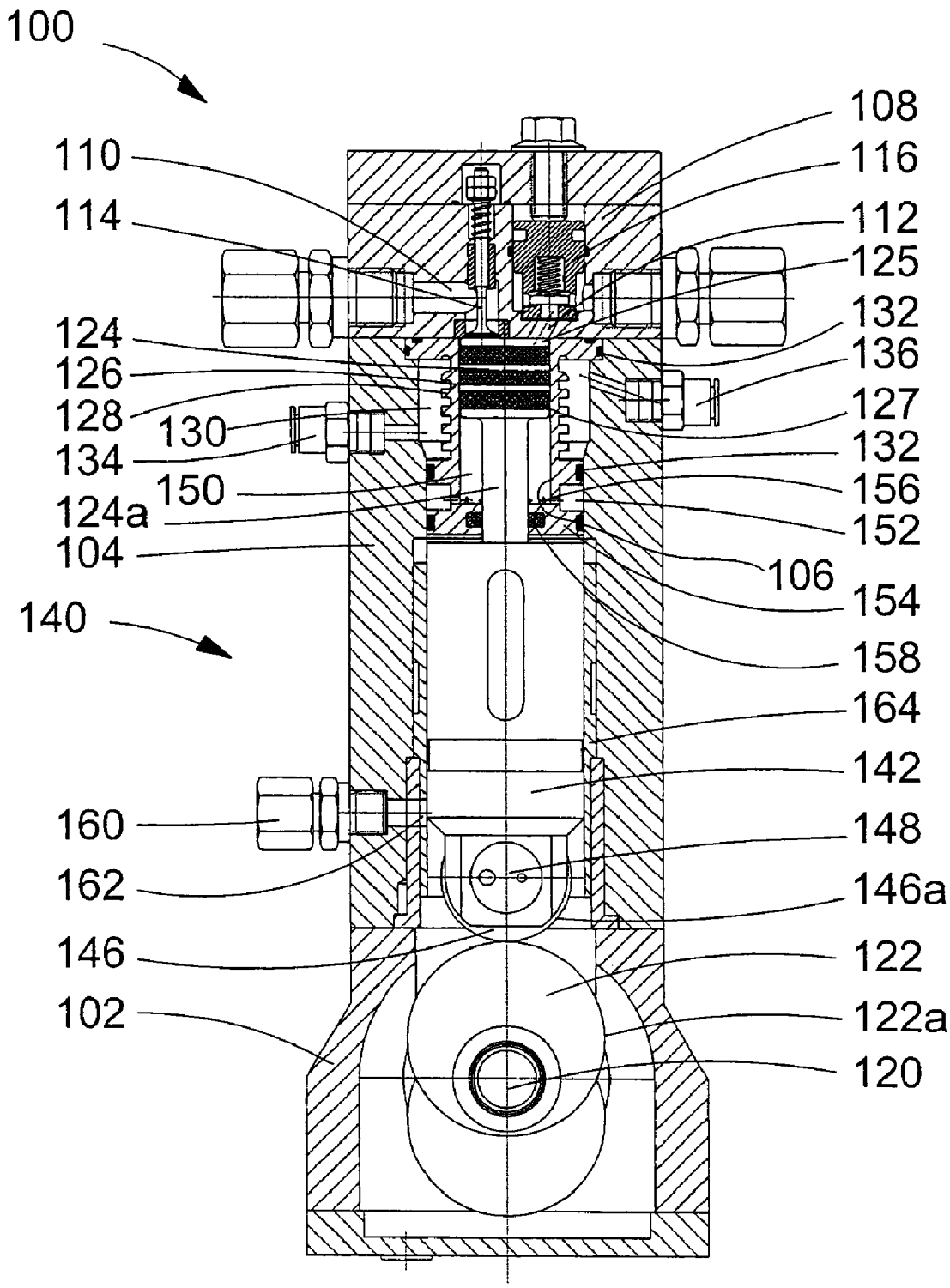
FIG. 1 is an end-view of a gas compressor with the compressor body cut away to reveal the piston, the roller tappet assembly and the camshaft.

FIG. 1 is a section end-view of gas compressor 100. Compressor 100 can be adapted to compress various types of gases. In a particular application, the gases can be fuel gases, which are combustible and consumable as fuel in an internal combustion engine, such as gases selected from the group consisting of natural gas, a constituent of natural gas individually, propane, bio-gas, landfill gas, hydrogen gas, and mixtures of such gaseous fuels. In preferred embodiments for this application, the mechanical energy for driving compressor 100 can be supplied from the internal combustion engine that consumes the high-pressure gas discharged from compressor 100. For engines that inject the fuel gas directly into the combustion chamber when the engine's piston is near or at top dead center, it is necessary to supply the fuel gas at a high pressure in order to overcome the in-cylinder pressure and to achieve the desired fuel penetration and mixing. Gas compressor 100 is operable to discharge gas at 200 bar absolute pressure (about 3000 psia), and preferably at least 250 bar absolute pressure (about 3600 psia), and more preferably at about 300 bar absolute pressure (about 4350 psia). All pressures disclosed hereinafter are absolute pressures. The disclosed compressor is particularly suited to applications in which a high compression ratio and high discharge pressure is desired. Currently known gas compressors can achieve similar discharge pressures, but are more complex and expensive or are not available to handle mass flow rates that would be suitable for supplying fuel to the engine of a vehicle. That said, the size of the disclosed compressor can be scaled to suit the requirements of a specific application, and can be useful for both vehicular and stationary applications. For example, another application suitable for the disclosed compressor is for dispensing gas at a filling station to re-fill high-pressure gas storage vessels. When the disclosed compressor is configured as a multi-stage compressor, in preferred embodiments each stage can have a compression ratio between 6:1 and 7:1. Tested compressors have demonstrated a compression ratio of about 6.7:1.

While there are certain advantages to coupling the compressor camshaft to an internal combustion engine that also consumes the high-pressure discharge gas, in other embodiments, an electric motor can be employed instead of an internal combustion engine to drive the compressor. For example, if the gas is not a fuel gas the compressor's camshaft can be coupled to an electric motor, and such an arrangement would still benefit from the other advantageous features of the disclosed compressor and the method for operating it.

The compressor body comprises cam case 102 and at least one cylinder block 104. Cylinder block 104 can house a plurality of cylinder bores, which can be arranged in an in-line arrangement behind illustrated cylinder bore 106. Cylinder bore 106 opens onto cam case 102 and externally onto an outer surface of cylinder block 104. The outer surface of cylinder block 106 is covered by cylinder head 108, which comprises inlet passage 110 through which an intake gas stream is introducible into cylinder bore 106, and discharge passage 112 through which a discharge gas stream is dischargeable from cylinder bore 106. Inlet valve 114 is disposed in inlet passage 110, and outlet valve 116 is disposed in discharge passage 112.

In preferred embodiments, inlet valve 114 is a poppet valve and outlet valve 116 is a plate valve. Conventional gas compressors typically employ plate valves for both the inlet and outlet valves. An advantage of employing a poppet valve for the inlet valve is that it can reduce the parasitic volume because the spring for biasing this valve in the closed position can be positioned above the valve stem and outside of compression chamber 125 instead of inside compression chamber 125, below the plate of a plate valve. U.S. Pat. No. 5,078,580, already introduced above in the background discussion, provides a good example of the prior art, and also illustrates how using a plate valve for the inlet valve can increase the parasitic volume. In the '580 patent the figures show piston heads that have recesses to accommodate the inlet plate valve, adding to the parasitic volume. A poppet valve can be spring biased to a closed position, and to automatically open against the bias of the spring when the intake gas pressure is a predetermined amount higher than the gas pressure in compression chamber 125. In addition, the valve element for poppet valves can be designed with a shape that allows smoother fluid flow and lower entrance losses, compared to a plate valve, providing another advantage to employing a poppet style valve for the inlet valve.

Camshaft 120 is rotatably mounted in cam case 102 with cam 122 associated with camshaft 120 so that cam 122 rotates around the axis of camshaft 120 when camshaft 120 rotates. Cam 122 comprises perimeter surface 122*a*, which is aligned with the centerline axis of cylinder bore 106. In the preferred embodiment illustrated in the figures, cam 122 has a circular profile.

Piston 124 is a single-acting piston that is reciprocable within cylinder bore 106. The boundaries for compression chamber 125 are defined by piston 124, cylinder bore 106, and cylinder head 108. In the illustrated preferred embodiment, cylinder liner 126 defines cylinder bore 106. Cylinder liner 126 is known as a "wet" liner because in cooperation with cylinder block 104, cylinder liner 126 defines cooling cavity 130 through which a liquid coolant can be circulated. The outer surface of cylinder liner 126, which faces cooling cavity 130 preferably comprises fins 128, which help to structurally strengthen cylinder liner 126, while providing more surface area for dissipating heat from cylinder liner 126. Seals 132 are provided to contain the coolant within cooling cavity 130. Coolant enters into cooling cavity 130 through coolant inlet 134, and exits cooling cavity 130 through coolant outlet 136.

A liquid-cooled system is preferable to an air-cooled system because it is important to prevent overheating of piston seals 127, and a liquid coolant can be more efficient in reducing the temperature of cylinder liner 126. Whereas conventional compressors have commonly employed C-shaped ring seals with a gap that allows some gas to blow-by the piston, in preferred embodiments of the presently disclosed compressor, piston seal 127 is made from a resilient material in the shape of a continuous ring that can be stretched around the circumference of piston 124 and installed in a groove provided in the piston's cylindrical surface. Piston seal 127 preferably comprises polytetrafluoroethylene, reinforced with embedded glass or carbon fibers. During operation of the compressor, the gas being compressed in compression chamber 125 can rise to a temperature of 250° C. For seals that comprise polytetrafluoroethylene, it is preferred to keep the temperature of piston seals 127 below 220° C. and more preferably below 200° C. to extend their service life, and this can be achieved with a liquid-cooled system. The advantage of using seals comprising polytetrafluoroethylene is that good sealing with reduced blow-by can be achieved without seal lubrication, enabling "oil free" operation.

If compressor 100 is employed to supply a gaseous fuel to an internal combustion engine, piping can be provided to route liquid coolant from the engine cooling system to cooling cavity 130 to thereby integrate the cooling system for compressor 100 with that of the engine. In addition, the camshaft for compressor 100 can be efficiently driven by rotational energy delivered from the engine's crankshaft.

In addition to helping to define cooling cavity 130, there are other advantages associated with employing cylinder liner 126. For example, with compressors employed for mobile applications it is desirable to reduce the overall weight of compressor 100. Cylinder liner 126 can be made from steel, while other parts of the cylinder block can be made from a lighter material such as aluminum.

The performance and durability of cylinder liner 126 can be improved by coating the bore surface with a thin film coating that has a lower friction coefficient than steel and/or a relatively harder surface. Diamond-like carbon thin film coatings are preferred because they can provide both a lower coefficient of friction and a higher hardness compared to steel. For coating cylinder liner 126, the diamond-like carbon thin film can have a thickness of between about one and ten micrometers with a thickness of between three and seven micrometers being preferred. Diamond-like carbon is a dense metastable form of amorphous carbon (a—C) or hydrogenated amorphous carbon (a—C:H) containing significant $sp^3$ bonding. The $sp^3$ bonding confers diamond-like properties such as mechanical hardness, low friction and chemical inertness. Diamond-like carbon thin films can be deposited at room temperature onto Fe substrates. Methods of depositing diamond-like thin films include ion beam or plasma deposition, chemical vapor deposition, magnetron sputtering, ion sputtering, laser plasma deposition, and ion plating, with cold plasma deposition being a preferred method. The common factor in these processes is deposition from a beam containing medium energy (10-500 eV) ions. In a preferred embodiment, the diamond-like carbon thin film coating can have a Rockwell number of at least 2000 and more preferably 4000. The hardness of the disclosed coating is advantageous for durability, but another important feature of such coatings is their smoothness. Diamond-like carbon thin films can have a friction coefficient that is less than 0.2 (when dry against steel), which helps to improve sealing and compressor performance while also reducing heat generated between piston seals 127 and cylinder liner 126.

In addition to the cooling system and the coating on cylinder liner 126, compressor 100 can also comprise other features to improve the durability of piston seals 127, for example by reducing piston velocity and the temperature of piston seals 127. As mentioned in the background discussion, conventional compressors are typically designed to reduce their cylinder bore diameter to piston stroke ratios, because with this approach it is possible to reduce the parasitic volume. In combination with other features disclosed herein such as the poppet-style intake valve that allows a reduction in parasitic volume, the presently disclosed compressor can employ cylinder bore diameter to piston stroke ratios higher than one to reduce piston velocity. Compared to conventional compressors of similar design, a shorter stroke and a larger bore allows compressor 100 to operate with a higher camshaft speed of rotation, while keeping the mean piston velocity below 6 meters per second. An experimentally tested compressor achieved a compression ratio of about 6.7:1 (an inlet pressure of 30 bar, and an outlet pressure of 200 bar), configured with a stroke length of 18 millimeters and a bore with a 20 millimeter diameter. With this configuration the mean piston velocity was about 1 meter per second with a camshaft speed of 1750 revolutions per minute. Maximum piston speed is preferably less than 12 meters per second. Conventional compressors with longer strokes operating at the same speed have higher piston velocities, resulting in higher piston seal temperatures and lower piston seal durability.

Reciprocating motion is transferred to piston 124 from cam 122 through roller tappet assembly 140. Roller tappet assembly 140 is interposed between piston 124 and cam 122 and comprises tappet body 142 that is contactable with piston 124, and roller 146, which has rolling surface **146*a* in contact with perimeter surface 122*a* of cam 122. Pin 148 extends through roller 146 defining an axis of rotation for roller 146. Pin 148 is supported by mounting points provided by tappet body 142**.

The pressure of the gas in compression chamber 125 contributes significantly to the Hertzian pressure between roller 146 and cam 122. To reduce this Hertzian pressure, with the disclosed compressor design, pressurized gas can be introduced into pressure compensation chamber 150 through pressure compensation passage 152. Pressure compensation chamber 150 is interposed between piston 124 and cam 122 and is bounded in part by a surface of piston 124 that is opposite to the piston surface that faces compression chamber 125 and cylinder head 108. As shown in FIG. 1, pressure compensation chamber 150 is defined by cylinder bore 106, piston 124, and piston guide plate 154. More of pressure compensation passage 152 can be seen in the side view of FIG. 3. In the illustrated embodiment, pressure compensation passage 152 comprises an annular header that is provided within cylinder block 104, with a plurality of ports 156 through which pressurized gas can flow into and out from pressure compensation chamber 150. Seal 158 is provided within a groove in piston guide plate 154 to provide a dynamic seal between reciprocable piston stem **124*a* and piston guide plate 154. In a preferred embodiment, seal 158, like piston seals 127, comprises polytetrafluoroethylene, which can be reinforced with carbon or glass fibers. Like cylinder bore 106, the surface of piston stem 124***a* that interacts with seal 158 can be coated with a thin film to improve sealing by providing a harder and smoother surface. Again, diamond-like carbon thin film coatings are preferred because of their hardness and smoothness properties, but other thin film coatings can be used instead such as Titanium Nitride (TiN) coatings or Chromium Nitride (CrN) coatings. Other elements can also be added to the composition of diamond-like carbon coatings such as Si, O, N, and B. For example, Si—O diamond-like carbon coatings can also provide a low coefficient of friction.

Pressurized gas can be supplied to pressure compensation passage 152 from the intake gas stream that supplies gas to compression chamber 125 during an intake stroke. In such an arrangement, when designing compressor 100, the area of the piston surface that faces pressure compensation chamber 150 can be selected relative to the area of piston 124 that faces compression chamber 125, to offset a desired amount of the force generated by gas pressure acting on the piston, and to thereby reduce Hertzian pressure between roller 146 and cam 122. In this way, even in compressors that are supplied with gas from a variable pressure source, gas pressure in pressure compensation chamber 150 automatically matches intake gas pressure. However, in some arrangements, for example, in a multi-cylinder or multi-stage compressor it can be simpler to supply pressurized gas to pressure compensation chamber 150 from a single source. In one embodiment, that source can be the discharge line from the final compression stage or another source of high-pressure gas. In such an arrangement, it is possible that the gas pressure in pressure compensation chamber 150 can be too high if it inhibits the movement of piston 124, and in this case compressor 100 can employ a pressure control valve that is operable to regulate gas pressure within at least one of the pressure compensation chambers. For example, one pressure control valve could be associated with the pressure compensation chambers for each stage of compression.

Figure 2:
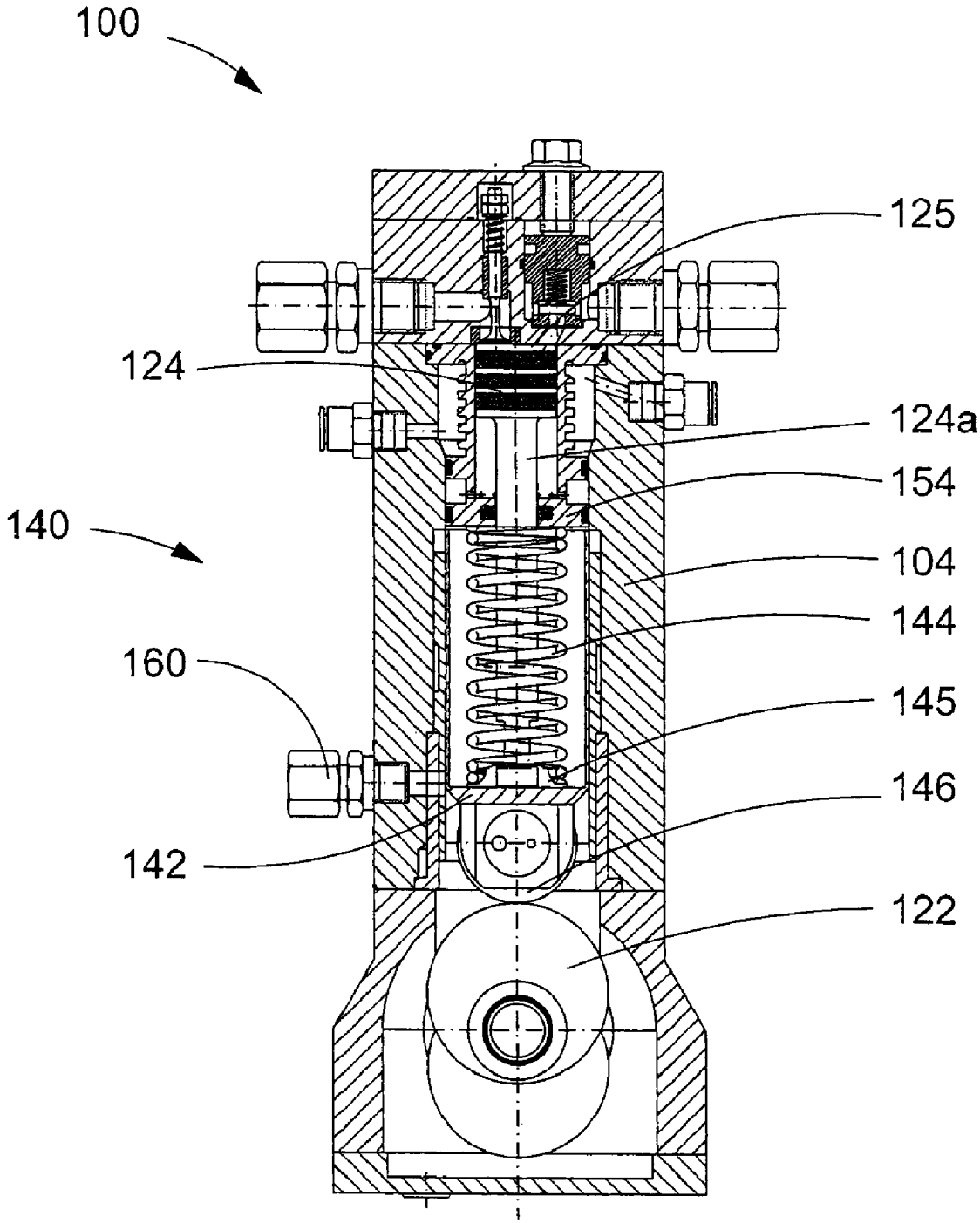
FIG. 2 is another end-view of the gas compressor of FIG. 1, but with the roller tappet assembly also cut away to reveal the interior of a preferred embodiment of the roller tappet assembly.

Similar features in different figures are labeled with the same or like reference numbers. Reference is now made to FIG. 2, which shows the same view as in FIG. 1, but with a cut away to show the interior of roller tappet assembly 140. FIG. 2 shows, in a preferred embodiment, how roller tappet assembly 140 can be constructed with mechanical means to bias contact with piston 124 and cam 122, respectively.

In this embodiment, piston 124 comprises stem 124*a*, which extends from piston 124 in the direction of roller tappet assembly 140. In a preferred embodiment, piston 124 can be connected to spring 144, but not fixedly attached to tappet body 142, and in this way piston 124 remains free-floating in that it can still move independently from tappet body 142, and a force applied from spring 144 and/or gas pressure is still needed to maintain piston stem 124*a* in contact with tappet body 142. Because of the high gas discharge pressures, gas pressure in compression chamber 125 normally provides the largest force that urges piston stem 124*a* into contact with tappet body 142. By offsetting some of the force generated by the gas pressure acting on piston 124, the gas pressure in pressure compensation chamber 150 reduces Hertzian pressure between roller 146 and cam 122, increasing the durability and service life of these components.

Because piston 124 is free-floating, in another embodiment (not shown), piston 124 can be detached from stem 124*a*, and stem 124*a* could be attached instead to tappet body 142. However, the embodiment shown in FIG. 2 is preferred because it provides a simple arrangement for employing spring 144 for biasing both piston stem 124*a* and cam 122 into contact with tappet body 142. While gas pressure in compression chamber 125 normally provides ample force for ensuring contact between piston 124 and roller tappet assembly 140, and between roller tappet assembly 140 and cam 122, there are times during the operation of the compressor when inertial forces acting on roller tappet assembly 140 could cause roller 146 to lift away from cam 122, but for spring 144. To guard against this possibility, spring 144 is disposed between cylinder block 104 and tappet body 142 to provide a continuous contact force between roller 146 and cam 122. In the illustrated preferred embodiment, spring 144 is supported at one end by piston guide plate 154, which is in fixed relationship to cylinder block 104. At the other end, spring 144 bears against washer 145 through which it contacts tappet body 142. In this arrangement, washer 145 can also be conveniently attached to a flange provided at the tip of piston stem 124*a*, whereby spring 144 also applies a force on piston stem 124*a* to urge it into contact with tappet body 142. In this way, spring 144 keeps piston 124 in contact with tappet body 142 despite inertial forces acting on piston 124 at the end of a compression stroke, or friction forces during an intake stroke.

To further improve durability and to reduce friction in roller tappet assembly 140, compressor 100 preferably comprises a lubrication system for providing pressurized oil lubrication to roller tappet assembly 140 to lubricate between tappet body 142 and cylinder block 104, and between roller 146 and pin 148 while the compressor is operating. As shown in FIGS. 1 and 2, the lubrication system comprises lubrication inlet 160 through which lubricating oil can be introduced into cylinder block 104 near roller 146 and pin 148. Lubricating oil introduced through lubrication inlet 160 can be directed through channel 162 provided in tappet sleeve 164 to lubricate around the circumference of tappet body 142. Similarly, channel 162 can have a branch (not shown) for directing lubricating oil to roller 146 and pin 148. A pressure of between about two and five bar (between about 30 and about 75 psia) is sufficient for delivering lubricating oil to roller tappet assembly 140.

In preferred embodiments, tappet sleeve 164 is made from a softer material than tappet body 142. For example, tappet body 142 can be made from steel and tappet sleeve 164 can be made from brass. To further improve durability, the surfaces of tappet body 142 that slide against bearing sleeve 164 can be coated with a diamond-like carbon thin film. If the clearance between tappet body 142 and tappet sleeve 164 is too large, this can result in tappet body 142 tilting in response to the friction forces between roller 146 and cam 122, and undesirably higher forces acting on the opposite upper and lower edges of tappet sleeve 164. On the other hand, if the clearance between tappet body 142 and tappet sleeve 164 is too small, this can inhibit the lubrication oil from flowing into the clearance gap, and tappet body 142 can seize against tappet sleeve 164, resulting in damage or more friction and wear therebetween. A clearance gap of between about 20 and 40 micrometers has been found to be suitable.

A method of compressing gas to a high pressure follows directly from the disclosed apparatus. Accordingly, in describing the method, reference numbers from the Figures are employed though it will be understood that other physical embodiments not illustrated may also comprise the features of the disclosed apparatus, which enable the presently disclosed method. One of the enabling features of the disclosed compressor is reciprocable single-acting piston 124 and pressure compensation chamber 150. The disclosed method comprises introducing gas into compression chamber 125 from an intake gas stream during an intake stroke of piston 124, and offsetting a portion of the forces acting on piston 124 from gas pressure within compression chamber 125 by introducing a pressurized gas into pressure compensation chamber 150, which is disposed between piston 124 and camshaft 120. Pressure compensation chamber 150 is bounded in part by a surface of piston 124 that is opposite to a surface that faces compression chamber 125. Compressor 100 can have one or a plurality of cylinders. The pressurized gas that is directed to pressure compensation chamber 150 can be supplied from the intake gas stream, or from a discharge passage associated with one of the cylinders. The method can further comprise controlling pressure of the gas that is introduced into pressure compensation chamber 150 responsive to gas intake pressure, whereby Hertzian pressure between cam 120 and roller 146 is maintained below a predetermined value. For example, gas pressure in pressure compensation chamber 150 can be controlled so that Hertzian pressure is maintained below 1200 N per square millimeter.

According to the disclosed method, gas pressure in pressure compensation chamber 150 only offsets some of the force generated by gas pressure in compression chamber 125, because the force generated by gas pressure in compression chamber 125 helps to maintain piston 124 in contact with tappet body 142, allowing piston 124 to be free-floating, which helps with durability and manufacturability, by reducing the number of components to be precisely aligned. Spring 144 can also be employed to contribute to the forces that urge piston 124 into contact with tappet body 142, while piston 124 remains free-floating. In some embodiments, spring 144 need not bias piston 124 into contact with tappet body 142, however, spring 144 functions to apply a continuous force to roller 146 to maintain contact between roller 146 and cam 122.

With multi-stage compressors, the method preferably comprises cooling gas discharged from one compression stage before it is directed to a subsequent compression stage. Gas discharged from one stage is preferably cooled to less than 70 degrees Celsius before it is directed to a subsequent compression stage. The method can also comprise cooling the gas that is discharged from the compressor's final compression stage.

In describing the apparatus, it has already been noted that a cylinder bore diameter to piston stroke length ratio greater than one can be employed to allow higher camshaft speeds while keeping piston velocity low. Accordingly, the method can comprise limiting mean piston velocity at maximum camshaft speed to less than 6 meters per second over the course of a compression cycle, and preferably to less than 3 meters per second. In a preferred embodiment, camshaft 120 can be rotated at speeds from zero to 2000 revolutions per minute, while keeping mean piston velocity below predetermined maximums. Different cam profiles produce different piston speed profiles, and preferably maximum piston velocity is limited to less than 12 meters per second.

A preferred method of operating compressor 100 comprises driving camshaft 120 with an internal combustion engine that consumes a fuel gas that is compressed by compressor 100. The power requirement for driving compressor 100 varies with gas intake pressure. For example, for vehicular engine applications, fuel gas is stored on-board the vehicle and compressed gas can be supplied from a pressure vessel. Initially, when the pressure vessel is full, pressurized fuel gas can be supplied directly from the storage tank, for example, at pressures as high as 300 bar, in which case, it may even be desirable to reduce fuel gas pressure before supplying it to the fuel injection valves. As long as gas supply pressure from the pressure vessel exceeds the desired fuel gas injection pressure, compressor 100 can remain idle, requiring virtually no power in this mode. As fuel gas is withdrawn from the pressure vessel, supply pressure eventually declines below the desired injection pressure and compressor 100 can be activated intermittently to maintain fuel gas pressure at or above the desired injection pressure. An accumulator vessel can be provided in the fuel supply system between compressor 100 and the fuel injection valves to make fuel available at the desired injection pressure. During intermittent operation, the power required for operating compressor 100 remains modest. When the gas pressure in the pressure vessel drops to below half of the desired injection pressure, compressor 100 begins to operate more frequently, and the power requirement for driving compressor 100 also increases. By way of example, for a system with a pressure vessel rated for storing gas at 300 bar, a desired injection pressure of about 250 bar, the compressor can idle until storage pressure drops below 250 bar. With a two-stage compressor as described herein with a maximum fuel gas mass flow rate of about 17 g/s, and a 6.6:1 compression ratio for each stage, gas pressure in the storage vessel can drop to 125 bar with the compressor still requiring less than 4 kW to compress the fuel gas to the desired injection pressure of 250 bar. When gas pressure in the pressure vessel drops to below 60 bar, the power required to drive the compressor is still less than 8 kW. By the time gas pressure at the compressor intake drops to below 10 bar, the compressor is running continuously, and the power required to drive the compressor can be higher than 16 kW. For gas pressures below this, the pressure vessel is considered empty. In this example, the mean power requirement for driving the compressor to deliver a gas at 250 bar from a full storage vessel until it is empty is calculated to be about 4 kW. An engine supplied with fuel gas from such a fuel supply system can be classed as a medium duty engine with a power output up to about 225 kW.

Figure 3:
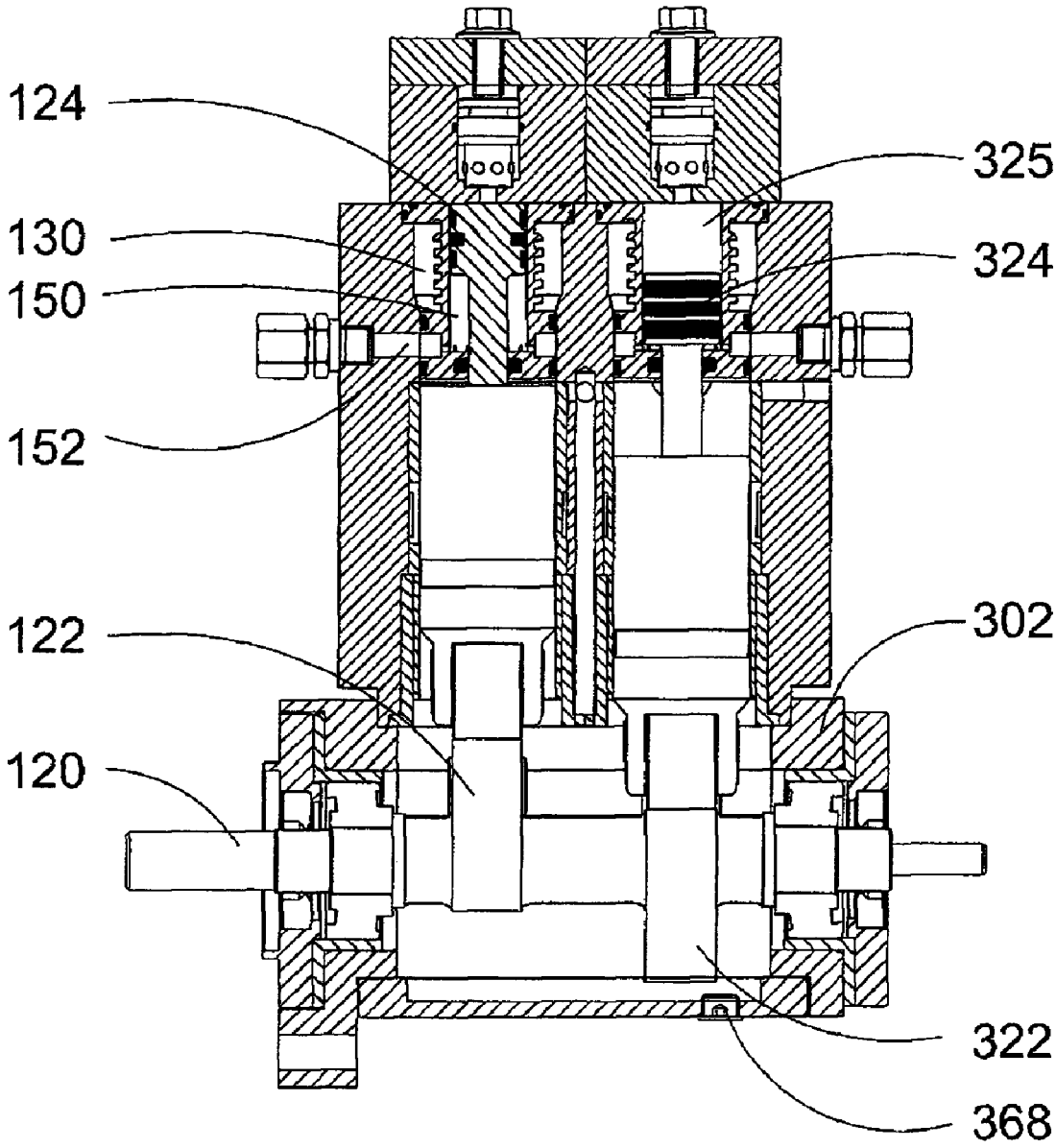
FIG. 3 is a side-view of a single stage gas compressor with the compressor body cut away to reveal two cylinder bores with pistons that can be reciprocated 180 degrees out of phase with each other.

FIG. 3 is a side view of a compressor with two single-acting pistons 124 and 324 that operate in parallel for single-stage gas compression. This side view could be the side view of the compressor shown in FIGS. 1 and 2. From the side-view the inlet for pressure compensation passage 152 can be seen. The side view shows how crankshaft 120 is supported by bearings provided in the walls of cam case 102. Cams 122 and 322 are arranged so that the compressor pistons reciprocate out of phase by 180 degrees of camshaft rotation, and this helps to reduce the pressure pulsations in the discharge line, while also balancing the load on camshaft 120. Pressure compensation chamber 150, below piston 124 is at its largest when piston 124 is at top dead center, and at its smallest when the piston is at bottom dead center. Conversely, piston 324 is shown in the bottom dead center position, where the piston 324 is at the end of the intake stroke and the beginning of the compression stroke, with compression chamber 325 at its largest volume.

Cam case 302 comprises drain port 368 through which lubrication oil can be removed on a periodic or continuous basis. If lubrication oil is drained on a continuous basis, lubrication oil can flow by gravity to a filter and then returned to a reservoir from which it can be recirculated by a lubrication oil pump.

A single-stage compressor with this configuration has been built and tested. With a cylinder bore diameter of 20 mm and the piston stroke length of 18 millimeters, the displacement for each cylinder was 5654.9 cubic millimeters. Supplied with natural gas with an intake gas pressure 30 bar (about 435 psia), a discharge pressure of 200 bar (about 3000 psia) was achieved, realizing a compression ratio of about 6.7:1. The camshaft was rotated at a speed of 1750 rpm, and a mass flow rate of 5.1 g/s was measured. With the camshaft rotating at 1750 rpm, the mean piston velocity was 1.05 meters per second. A compressor with this configuration is suitable, for example, for supplying a fuel gas to a light-duty direct injection engine with a power output of about 66 kW.

Figure 4:
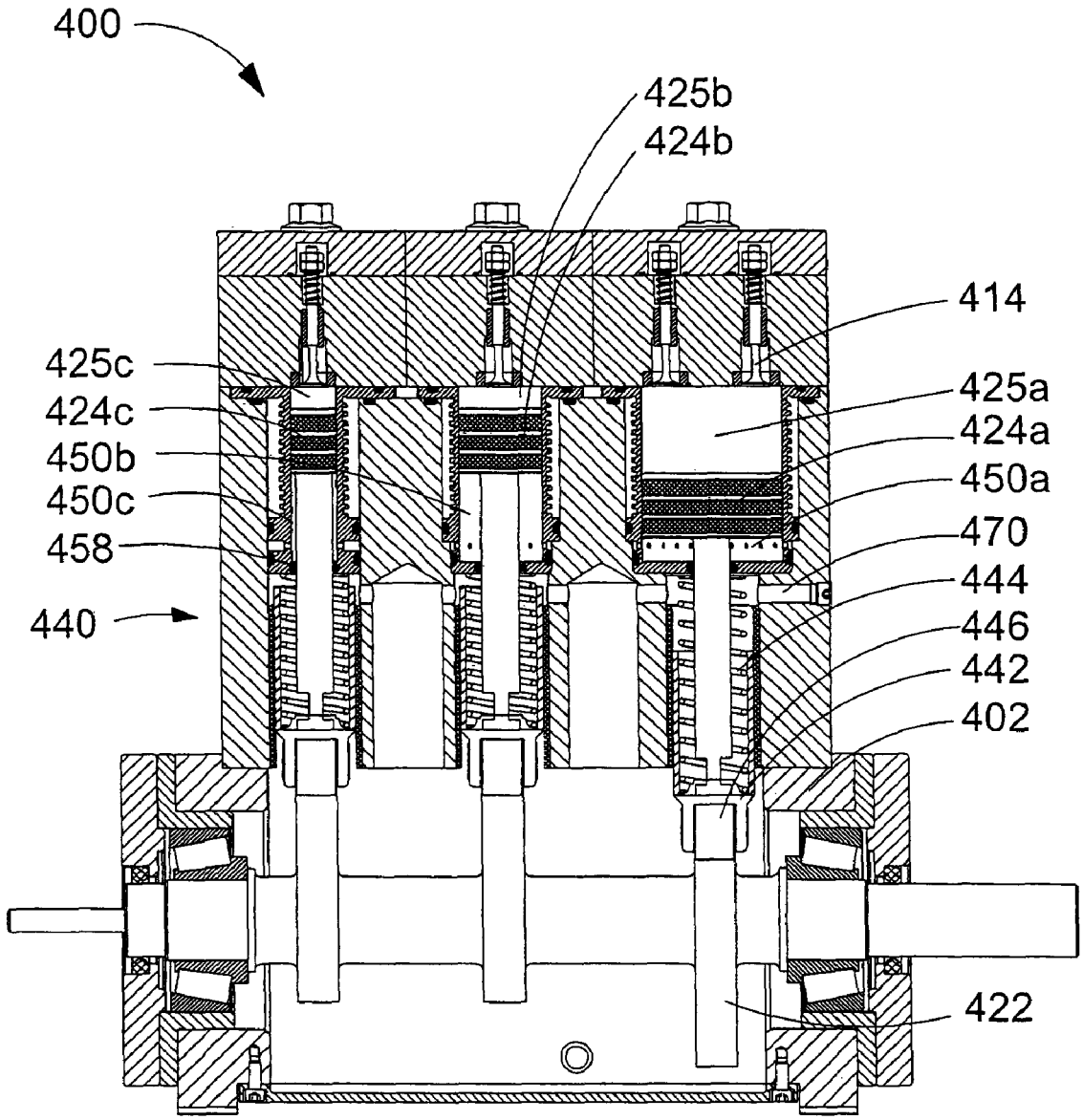
FIG. 4 is side-view of a three-stage gas compressor with the compressor body cut away to reveal the pistons, roller tappet assemblies, and the camshaft.

FIG. 4 is a side view of a multi-stage gas compressor. In this embodiment, there are three compression stages, but persons with the technology involved here will understand that other numbers of stages are equally possible. For example, compressors with four compression stages are common. The number of stages depends more upon the requirements of the application for which the compressor is intended, than technical limitations. For a given overall compression ratio, a greater number of compression stages permits lower compression ratios to be employed in each compression stage, which can reduce the gas temperate rise in each stage thereby increasing compression efficiency. However, each additional stage adds complexity by requiring additional components for each compression stage and intercooling between each stage. With the presently disclosed compressor, compression ratios as high as 8:1 for each compression stage are possible, but compression ratios between 6:1 and 7:1 are preferred for better compressor efficiency.

In a multi-stage compressor, the discharge passage associated with at least one cylinder bore communicates with an inlet passage associated with another cylinder bore. In the embodiment of FIG. 4, early compression stages have larger piston diameters than later compression stages. An advantage of this arrangement is that as gas pressure increases in each stage, piston surface area also decreases, so the Hertzian pressure between the rollers and cams associated with the respective compression stages can be balanced. In an alternative arrangement (not shown), all of the pistons can have the same diameter, but there can more first stage pistons than second stage pistons, and more second stage pistons than third stage pistons. For example, there could be four first-stage pistons and cylinders, and two second-stage pistons and cylinders, and one third-stage piston and cylinder. The number of cylinders for each stage would be selected based upon the desired compression ratio for each stage.

In a multi-stage compressor it is desirable to provide intercoolers (not shown) to cool the gas between stages. The gas is heated during the compression process and compression efficiency is improved by cooling the gas. The intercoolers can comprise a heat exchanger with a liquid coolant circulated there through or a fan operable to direct air to cool the gas. In addition to cooling the gas to improve compression efficiency, the intercoolers and the liquid cooled cylinder liners are both thermal management features that help to maintain the temperature of the cylinder liners at a lower temperature, helping to prolong the service life of the piston seals.

In both multi-stage and single-stage compressors, the pressurized gas that is directed to the pressure compensation chamber can be taken from the intake passage for each respective compression stage. In this way, gas pressure in the pressure compensation chamber is matched to the intake gas pressure. In another embodiment, the pressurized gas that is directed to the pressure compensation chambers can be taken from the discharge passage from the final compression stage. In this way, more flexibility is possible for controlling the Hertzian pressure between the rollers and cams. That is, by providing a pressure control valve for the pressure compensation passages for each compression stage, it is possible to manage the Hertzian pressure between the cams and rollers by controlling the gas pressure in the pressure compensation chambers. Preferably, Hertzian pressure is kept below 1400 N per square millimeter, and more preferably, less than 1200 N per square millimeter.

Referring specifically to the multi-stage compressor embodiment illustrated by FIG. 4, compressor 400 comprises first stage compression chamber 425*a*, second stage compression chamber 425*b*, and third stage compression chamber 425*c* with respective pistons 424*a*, 424*b*, and 424*c* reciprocable therein. To facilitate the larger volumetric flow rate into compression chamber 425*a*, a plurality of intake valves 414 can be employed, instead of one larger valve, allowing the same sized intake valve to be employed for all compression stages. FIG. 4 shows two intake valves 414 mounted in the cylinder head above compression chamber 425*a*. Compared to the other compression stages, the larger diameter of piston 424*a* permits such an arrangement with a plurality of intake valves. Roller tappet assemblies 440 can be the same for each compression stage and are essentially the same as the preferred embodiment of the roller tappet assembly that has been described with reference to FIG. 2, including spring 444 that biases roller 446 into contact with cam 422, and the piston stem into contact with tappet body 442.

Pressure compensation chambers 450*a*, 450*b*, and 450*c* are associated with respective compression stages for reducing the Hertzian pressure between respective rollers 446 and cams 422. Pressurized gas that escapes past seal 458 can be recovered from cam case 402 through ventilation port 470, which can be connected to pre-compressor stage so that it can be introduced back into the intake gas stream, or if the pressure of the intake gas stream is already very low, the recovered gas can be re-introduced directly back into the intake gas stream.

With respect to the illustrated embodiments of FIGS. 1-4, to simplify the description of the compressor, a single cylinder block with an in-line configuration has been shown. Persons familiar with the technology involved here will understand that other known configurations such as a V-shape or a radial configuration are possible. Different configurations can employ the same features illustrated by the in-line configuration, such as the pressure compensation chamber, the free-floating piston, the thin film coating of components such as the cylinder bore and piston stem, and the preferred piston diameter to stroke ratio for reducing piston velocity. These features, both individually and collectively provide a compressor with greater durability, allowing longer service intervals and lower operating costs.

Figure 5:
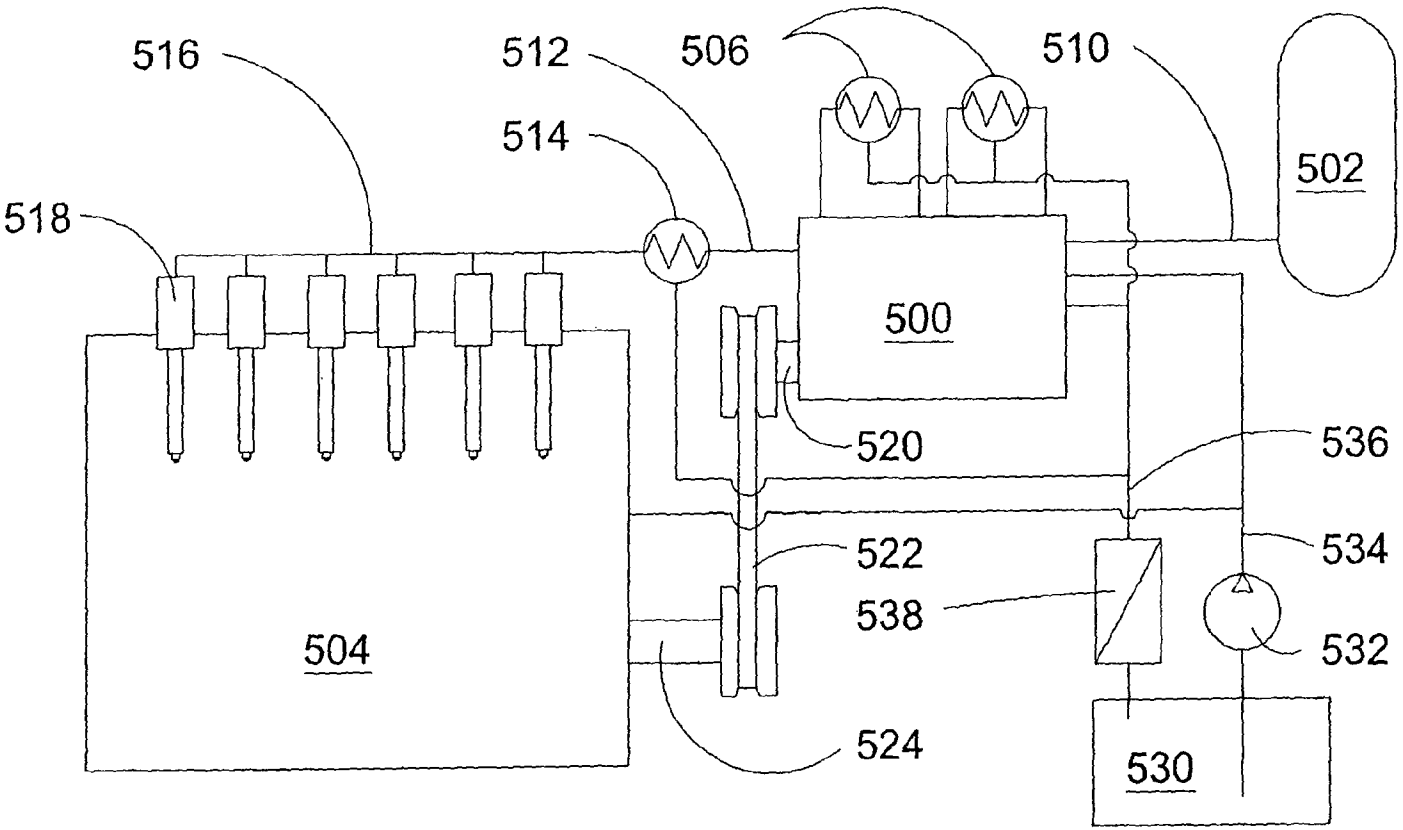
FIG. 5 is a schematic view of a gas compressor that supplies a fuel gas to an internal combustion engine, with a shared cooling system for the compressor and engine.

FIG. 5 illustrates a preferred application for compressor 500, which supplies a fuel gas from storage vessel 502 to internal combustion engine 504. Storage vessel 502 is designed and rated to hold gas at a predetermined pressure, which is determined by local regulations, cost factors, and vehicle range requirements. In one example, storage vessel 502 can be filled with compressed natural gas to a rated pressure of 300 bar. Supply line 510 supplies gas to compressor 500, which is a three-stage compressor, for supplying engine 504 with a combustible gaseous fuel through discharge line 512 at a predetermined pressure between 200 and 300 bar. Between compression stages, the fuel gas is directed through intercoolers 506, and in discharge line 512, the fuel gas is directed through aftercooler 514, before being delivered to fuel rail 516 that feeds fuel injection valves 518. An accumulator vessel (not shown) can be disposed between aftercooler 514 and fuel rail 516 to provide an adequate supply of high-pressure fuel gas to injection valves 518. Compressor camshaft 520 can be driven by engine 504, for example, by belt 522 and engine crankshaft 524.

Compressor 500 and engine 504 can share a cooling system. Liquid coolant can be stored in shared reservoir 530. Pump 532 can be activated to pump coolant from reservoir 530 to coolant supply pipe 534 which circulates liquid coolant to cooling cavities associated with the wet cylinder liners of compressor 500, cooling cavities in engine 504, intercoolers 506, and aftercooler 514. The warmed coolant is returned to reservoir 530 via return pipe 536, which directs the coolant through air-cooler 538. The system can further comprise a fan to increase the air flow through air-cooler 538.

While particular elements, embodiments and applications of the present invention have been shown and described, it will be understood, of course, that the invention is not limited thereto since modifications may be made by those skilled in the art without departing from the scope of the present disclosure, particularly in light of the foregoing teachings.

What is claimed is:

1. A gas compressor comprising:

(a) a compressor body that comprises a cam case and at least one cylinder block;

(b) a cylinder bore formed within said cylinder block and open onto said cam case and externally onto an outer surface of said cylinder block;

(c) a cylinder head covering said outer surface of said cylinder block and comprising an inlet passage through which an intake gas stream is introducible into said cylinder bore and a discharge passage through which a discharge gas stream is dischargeable from said cylinder bore;

(d) an inlet valve disposed in said inlet passage of said cylinder head;

(e) an outlet valve disposed in said discharge passage of said cylinder head;

(f) a camshaft rotatably mounted in said cam case with a cam associated with said camshaft that is aligned with a centerline axis of said cylinder bore;

(g) a single-acting piston reciprocable within said cylinder bore;

(h) a roller tappet assembly interposed between said piston and said cam for transmission of reciprocating motion from said cam to said piston, said roller tappet assembly comprising:

a tappet body contactable with said piston;

a roller with a rolling surface in contact with the perimeter surface of said cam; and a pin extending through said roller defining an axis of rotation, wherein said pin is supported by mounting points provided by said tappet body; and (i) a pressure compensation passage within said compressor body through which a pressurized gas is introducible to a pressure compensation chamber interposed between said piston and said cam case, wherein said pressure compensation chamber is bounded in part by a surface of said piston that is opposite to a surface of the piston that faces said cylinder head, and wherein said pressure compensation passage is fluidly connected to said surface of said piston that is opposite to said piston surface that faces said cylinder head.

2. The gas compressor of claim 1 further comprising a gas seal comprising polytetrafluoroethylene disposed between said compressor body and a piston stem, which extends from said piston to said roller tappet assembly.

3. The gas compressor of claim 2 wherein opposite said gas seal, a respective one of said piston stem and the surface of said roller tappet assembly, is coated with a thin film coating with a coefficient of friction lower than 0.2.

4. The gas compressor of claim 3 wherein said thin film coating is a carbon thin film coating with a thickness between 3 and 10 micrometers.

5. The gas compressor of claim 3 wherein said thin film coating is a carbon thin film coating that has a Vickers number of at least 2000.

6. The gas compressor of claim 1 further comprising a passage communicating between said intake gas stream and said pressure compensation passage for introducing said pressurized gas into said pressure compensation chamber.

7. The gas compressor of claim 1 further comprising a pressure control valve associated with said pressure compensation passage, said pressure control valve being operable to regulate gas pressure within said pressure compensating chamber.

8. The gas compressor of claim 1 wherein the ratio of said cylinder bore diameter to piston stroke length is greater than one.

9. The gas compressor of claim 1 further comprising a thin film coating with a lower friction coefficient than steel applied to a sliding surface of at least one of: (a) said tappet body opposite a bearing sleeve or said compressor body; and (b) said cylinder bore opposite to where said piston reciprocates.

10. The gas compressor of claim 9 wherein said thin film coating applied to said sliding surface is a carbon thin film with a thickness between 3 and 10 micrometers, a coefficient of friction less than 0.2, and a Vickers number of at least 2000.

11. The gas compressor of claim 1 further comprising a spring element disposed between said compressor body and said tappet body for biasing said roller into contact with said cam.

12. The compressor of claim 11 wherein said spring also acts to urge said piston into contact with said tappet body.

13. The gas compressor of claim 12 wherein said piston comprises a stem that extends into said tappet body and said stem comprises a flange that is contactable with said tappet body, said flange being urged towards said tappet body by said spring element.

14. The gas compressor of claim 1 further comprising a lubrication system comprising an inlet into said compressor body for introducing a liquid lubricant into a passage through which said liquid lubricant is directable to said roller, and a drain provided at a low point in said cam case through which said liquid lubricant is removable from said compressor body.

15. A method of compressing a gas using a compressor with a reciprocable single-acting piston driven by a camshaft that transmits motion to said piston through a roller tappet assembly, wherein the camshaft comprises a cam and the roller tappet assembly comprises a roller, said method comprising:

during an intake stroke of said piston, introducing gas into a compression chamber from an intake gas stream;

offsetting a portion of the forces acting on said piston from gas pressure within said compression chamber by introducing a pressurized gas through a pressure compensation passage and into a pressure compensation chamber between said piston and said camshaft, wherein said pressure compensation chamber is bounded in part by a surface of said piston that is opposite to a surface that faces said compression chamber, wherein said pressure compensation passage is fluidly connected to said surface of said piston that is opposite to said piston surface that faces said compression chamber.

16. The method of claim 15 further comprising supplying said pressurized gas to said pressure compensation chamber from said intake gas stream.

17. The method of claim 15 further comprising controlling pressure of gas introduced into said pressure compensation chamber responsive to pressure of said intake gas stream, whereby Hertzian pressure between said cam and roller is maintained below a predetermined value.

18. The method of claim 17 wherein said predetermined value for Hertzian pressure is 1200 N per square millimeter.

19. The method of claim 15 further comprising limiting mean piston velocity to less than 6 meters per second.

20. The method of claim 15 further comprising limiting maximum piston velocity to less than 12 meters per second.

21. The method of claim 15 further comprising rotating said camshaft at speeds from zero up to 2000 revolutions per minute.

22. The method of claim 15 further comprising coating at least one of said cylinder bore, a stem extending through said pressure compensation chamber, and a surface of said roller tappet assembly that slides against a bearing sleeve, with a thin film coating that increases the hardness and reduces the friction coefficient of the coated surface.

23. The method of claim 22 wherein said coated surface is coated with a carbon thin film coating.

24. The method of claim 23 further comprising producing said carbon thin film coating by a deposition process comprising deposition from a beam containing medium energy ions, between 10 and 500 eV.

25. The method of claim 15 further comprising maintaining Hertzian pressure between said roller and said cam less than 1400 N per square millimeter.

26. The gas compressor of claim 1 further comprising a gas seal comprising polytetrafluoroethylene disposed between said compressor body and said roller tappet assembly.

27. The gas compressor of claim 26 further comprising a gas seal comprising polytetrafluoroethylene disposed between said compressor body and a piston stem, which extends from said piston to said roller tappet assembly.

28. The gas compressor of claim 3 wherein said thin film coating is a carbon thin film coating that has a Vickers number of at least 4000.

29. The gas compressor of claim 9 wherein said thin film coating applied to said sliding surfaces is a carbon thin film with a thickness between 3 and 10 micrometers, a coefficient of friction less than 0.2, and a Vickers number of at least 4000.

30. The method of claim 15 further comprising limiting mean piston velocity to less than 3 meters per second.

31. The method of claim 15 further comprising maintaining Hertzian pressure between said roller and said cam less than 1200 N per square millimeter.

32. The gas compressor of claim 1 wherein said inlet valve is a poppet style valve and said outlet valve is a plate valve.

33. The gas compressor of claim 1 further comprising a stem that is attached to said tappet body and which extends towards said piston, wherein said piston is free-floating and urged into contact with said stem by gas pressure within said cylinder bore.

34. The method of claim 15 wherein the Hertzian pressure between the camshaft and roller tappet assembly is reduced.

* * * * *